US009346521B2

(12) United States Patent
Lachaud et al.

(10) Patent No.: US 9,346,521 B2
(45) Date of Patent: May 24, 2016

(54) VESSEL RECOVERY SYSTEM AND METHOD

(71) Applicant: TECHNIP FRANCE, Courbevoie (FR)

(72) Inventors: Emilie Lachaud, Villejuif (FR); Didier Renard, Houston, TX (US); Ludwig Gross, Paris (FR); Sylvain Routeau, St Cloud (FR)

(73) Assignee: TECHNIP FRANCE, Courbevoie (FR)

( * ) Notice: Subject to any disclaimer, the term of this patent is extended or adjusted under 35 U.S.C. 154(b) by 0 days.

(21) Appl. No.: 14/476,393

(22) Filed: Sep. 3, 2014

(65) Prior Publication Data

US 2016/0059937 A1 Mar. 3, 2016

(51) Int. Cl.
*B63B 23/40* (2006.01)
*B63B 27/30* (2006.01)

(52) U.S. Cl.
CPC ..... *B63B 27/30* (2013.01); *B63B 23/40* (2013.01)

(58) Field of Classification Search
USPC ..... 414/137.7, 139.2; 114/242, 243, 244, 114/245, 249, 253
See application file for complete search history.

(56) References Cited

U.S. PATENT DOCUMENTS

RE20,551 E * 11/1937 Rouse ..... B66D 1/48 114/268
3,536,023 A * 10/1970 Bascom ..... B63B 27/36 114/259
3,626,703 A * 12/1971 Richburg ..... B63C 7/16 114/312
3,889,621 A * 6/1975 Pease ..... B63B 21/22 114/210
4,067,282 A * 1/1978 Guinn ..... B63B 21/22 114/230.2
4,732,103 A * 3/1988 Culbertson ..... B63B 29/02 114/65 R
4,957,207 A * 9/1990 Thomas ..... B63B 23/00 114/362
6,178,914 B1 * 1/2001 Axelsson ..... B63B 23/06 114/242
6,983,714 B2 * 1/2006 Dove ..... B63B 21/04 114/230.2
7,690,434 B2 * 4/2010 Baross ..... B63B 21/507 114/230.12
2006/0118309 A1 * 6/2006 Head ..... B63B 21/26 166/358

* cited by examiner

*Primary Examiner* — Paul T Chin
(74) *Attorney, Agent, or Firm* — Jackson Walker L.L.P.

(57) ABSTRACT

A recovery system and method for recovering a deployed vessel having a rotatable support coupled with a stored recovery assembly, including a release unit, line, deployment weight, and drag device on the deployed vessel. A recovery vessel can have a hoist with a coupling element, such as a grapple. For recovery, the recovery assembly can be deployed from the deployed vessel. The drag device can assist in floating and/or maintaining a taut line, especially when the vessel is downwind of the drag device. The coupling element from the recovery vessel can couple with the taut line. Once coupled, the recovery vessel can raise the coupling element with the line, which can rotate the rotatable support to a lifting position above a center of gravity of the deployed vessel. The recovery vessel can then lift the deployed vessel vertically out of the water to a storage position.

15 Claims, 8 Drawing Sheets

VESSEL RECOVERY SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates to the recovery of a vessel by a larger vessel in water. More specifically, the disclosure relates to the recovery of a vessel from a larger offshore vessel, such as an offshore platform or ship.

2. Description of the Related Art

Larger vessels in water, such as offshore platforms, FPSOs, and ships, often deploy and retrieve smaller vessels for reconnaissance, transport, and maintenance, and when needed, evacuation. Often, the smaller vessels can be unmanned, other than when used for evacuation. Typically, the smaller vessels are launched by being lowered using hoists and rope to the surface of the water and released, and then later retrieved by the same manner.

The launch of the smaller vessel from the larger vessel can be somewhat straightforward. The smaller vessel can be deployed generally by being suspended from the larger vessel by ropes or cables attached to the bow and stem of the smaller vessel, and the ropes or cables are released after the smaller vessel is lowered and floating on the water. The retrieval can be more complicated. An operator can maneuver the smaller vessel into position to be retrieved by the system that released the vessel into the water. However, the different heave motion of the larger vessel compared to the smaller vessel can cause difficulties in reattaching the ropes or cables to hoist the smaller vessel up to a storage position with the larger vessel.

One system shown in GB Pat. No. 2,150,903 and entitled, "Method and Assembly for Launching or Retrieving a Lifeboat," describes in the Abstract: an assembly for launching or retrieving a lifeboat, pick-up boat or the like from a ship or a stationary installation includes a boat dock having float bodies. Control wires extending down to the sea from the ship or the stationary installation cooperate with guide means on the boat dock to control the dock during lowering and hoisting. In this manner, the boat dock can float in the sea and follow the wave movements, while at the same time being stabilized due to the control of the wires. There is a coupling means on the boat dock, which engages with a coupling means on the boat when the boat is in the dock. The system shows a boat with a ball on the end of a smaller diameter rod located on top of the boat that engages and disengages the coupling means (sized to fit the ball with the rod so that the ball does not slip through the coupling means) for launch and retrieval from the larger structure. For launch, the suspended dock with the boat is lowered to the water and the ball with the rod on the boat is released. For retrieval, the boat can approach the dock and as the boat passes under the dock horizontal bar, the ball and rod on the top of the boat can engage the horizontal bar to couple the boat with the dock, so that the dock and boat can be raised to a storage position. Variations of this system include lowering the boat on a separate line from the dock. However, the concentrated load from the tensile stresses with the ball and rod of the boat structure generally would require extra structural support that adds weight and may interfere with other desirable design features in the boat.

However, these systems generally depend on the maneuverability of the smaller vessel to approach a docking system in a controlled manner for retrieval. If maneuverability of the smaller vessel is lost, the retrieval of the vessel is compromised.

U.S. Pat. No. 8,578,872 discloses a life vessel retrieval system. The Abstract states: "A system for retrieving a life vessel from water and drawing the life vessel onto a deck of a rescue vessel comprises a life vessel system comprising: i) a tow-line comprising a first end portion secured to the life vessel and an opposed second end portion; and ii) a deployment system configured to deploy the second end portion of the tow-line into the water. The system further comprises a rescue vessel system comprising i) a towing device on the rescue vessel, the towing device configured to receive the second end portion of the tow-line and retract the tow-line to draw the life vessel towards the rescue vessel; and ii) a retrieval assembly assembled to the deck of the rescue vessel, the retrieval assembly configured to receive the life vessel as the life vessel is drawn towards the rescue vessel and to lift the rescue vessel onto the deck." The life vessel has a tow-line secured on one end to a forefoot of a keel and a drogue mounted to the other end to orient the vessel in the water. The rescue vessel includes a towing device configured to receive the second end of the tow-line and retract the tow-line to draw the life vessel toward the rescue vessel and then slide from the water along a rail onto the deck of the rescue vessel.

There remains then a need to provide an improved system and method for recovery of a vessel, such as when control of the vessel has been compromised and customary methods of retrieval are inadequate.

BRIEF SUMMARY OF THE INVENTION

The present disclosure provides a recovery system and method for recovering a deployed vessel having a rotatable support coupled with a stored recovery assembly, which can include a release unit, line, drag device, such as a drift anchor and/or buoy, and deployment weight on the deployed vessel. A recovery vessel can have a hoist with a coupling element, such as a grapple. For recovery, the stored recovery assembly can be deployed from the deployed vessel. The deployment weight can assist in initial deployment by pulling the recovery assembly into the water upon release of the recover assembly. The drag device can assist in maintaining the line taut, especially when the deployed vessel is downwind of the drag device. The taut line can assist in coupling with the coupling element from the recovery vessel. Once coupled, the recovery vessel can raise the coupling element with the line coupled thereto, which can rotate the rotatable support to a lifting position above a center of gravity of the deployed vessel. The recovery vessel can then lift the deployed vessel vertically out of the water to a storage position. The system can be used in emergency conditions such as during loss of control of the deployed vessel, and non-emergency conditions, such as when another option for recovering the deployed vessel is desired.

The disclosure provides a system for recovery of a deployed vessel in water, comprising a lift support coupled to a surface of the deployed vessel in line with a center of gravity of the deployed vessel, and a recovery assembly coupled to the lift support. The lift support comprises: a lift support frame coupled to the surface of the deployed vessel; a lift strop coupled to the lift support frame, the lift strop being rotatable from a first position when stored to a vertical position when used to lift the deployed vessel. The recovery assembly comprises: a recovery cable having a first portion and a second portion, the first portion coupled to the lift strop; a deployment weight coupled to the recovery cable; a drag device coupled to the second portion of the recovery cable; and a release unit comprising a release holder and a release actuator, the recovery cable being releasably coupled to the release unit. The recovery system can include a crane coupled to a recovery vessel having a crane coupler to releasably couple with the recovery cable and lift the deployed vessel vertically from the water.

The disclosure also provides a method of recovering a deployed vessel in water with a lift support and a recovery system coupled to the lift support, the lift support having a lift support frame coupled to a surface of the deployed vessel and a lift strop coupled to the lift support frame, and the recovery assembly having a recovery cable with a first portion and a second portion, the first portion coupled to the lift strop, a deployment weight coupled to the recovery cable, a drag device coupled to the second portion of the recovery cable, and a release unit having a release holder and a release actuator, the recovery cable being releasably coupled to the release unit. The method comprises: actuating the release actuator of the release unit; releasing the recovery cable with the drag device from the release unit; allowing the recovery cable to be pulled from the deployed vessel by the deployment weight into the water; dragging the recovery cable in the water with the drag device; orienting a recovery vessel with a crane to position a crane coupler in the water at an angle to the recovery cable; coupling the crane coupler with the recovery cable; lifting the crane coupler coupled to the recovery cable with the crane; rotating the lift strop from a first position to a vertical position in line with a center of gravity of the deployed vessel; and lifting the deployed vessel from the water with the lift strop. The method can further include rotating the crane with the crane coupler about a vertical axis to engage the crane coupler with the recovery cable.

DETAILED DESCRIPTION

Figure 1:
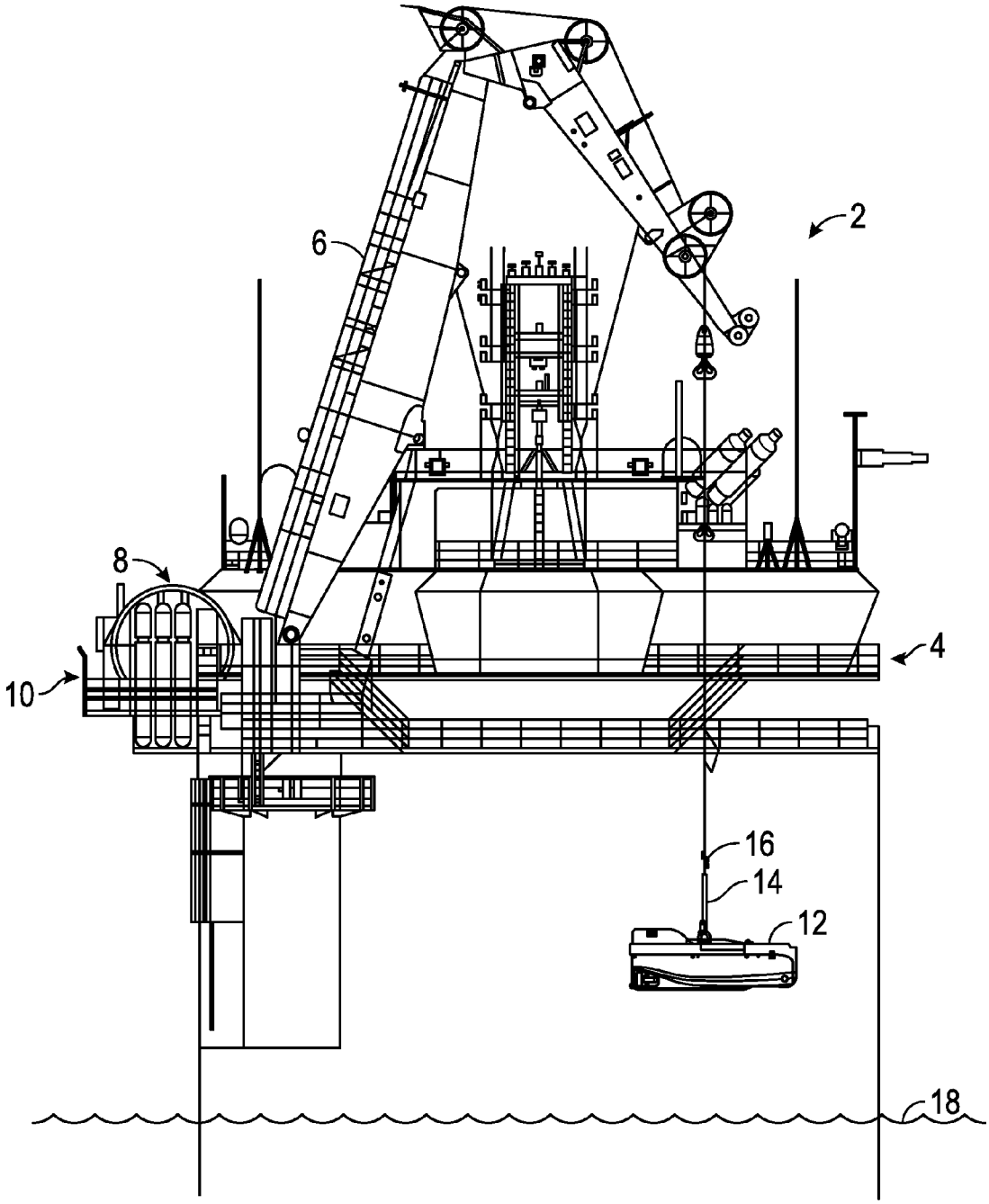
FIG. 1 is a schematic elevational view of an exemplary system for recovery of a deployed vessel in water according to the present disclosure.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, one or more elements may have been labeled with an "A" or "B" to designate various members of a given class of an element. When referring generally to such elements, the number without the letter can be used. Further, such designations do not limit the number of members that can be used for that function.

The present disclosure provides a recovery system and method for recovering a deployed vessel having a rotatable support coupled with a stored recovery assembly, which can include a release unit, line, drag device, such as a drift anchor and/or buoy, and deployment weight on the deployed vessel. A recovery vessel can have a hoist with a coupling element, such as a grapple. For recovery, the stored recovery assembly can be deployed from the deployed vessel. The deployment weight can assist in initial deployment by pulling the recovery assembly into the water upon release of the recover assembly. The drag device can assist in maintaining the line taut, especially when the deployed vessel is downwind of the drag device. The taut line can assist in coupling with the coupling element from the recovery vessel. Once coupled, the recovery vessel can raise the coupling element with the line coupled thereto, which can rotate the rotatable support to a lifting position above a center of gravity of the deployed vessel. The recovery vessel can then lift the deployed vessel vertically out of the water to a storage position. The system can be used in emergency conditions such as during loss of control of the deployed vessel, and non-emergency conditions, such as when another option for recovering the deployed vessel is desired.

FIG. 1 is a schematic elevational view of an exemplary system for recovery of a deployed vessel in water according to the present disclosure. The recovery system 2 generally includes a recovery vessel 4 having a crane 6. The term "recovery vessel" is used broadly to include floating and fixed offshore platforms, FPSOs, ships, and other structures that can be used in a water environment to lift the deployed vessel from the water. The crane 6 generally includes a lifting system 8 such as hydraulic cylinders, winches, and other equipment, associated with cranes. The crane also generally includes a rotation system 10 that allows the crane to rotate about its central axis as it performs its functions. The system 2 also includes a deployed vessel 12 having a lift support 14. The lift support 14 can be coupled to a recovery coupler 16 on the crane, such as a grappler hook, so that the crane can lift the recovery vessel vertically from the water surface 18, as described below in an exemplary embodiment.

Figure 2:
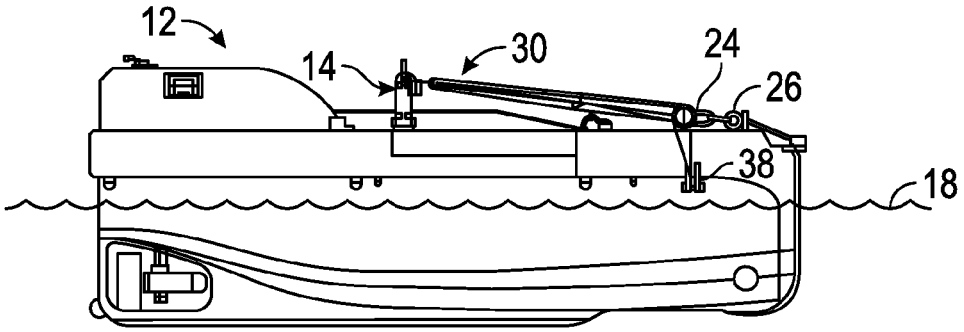
FIG. 2 is a schematic elevational view of a deployed vessel in water with an exemplary lift support and recovery assembly.
Figure 3:
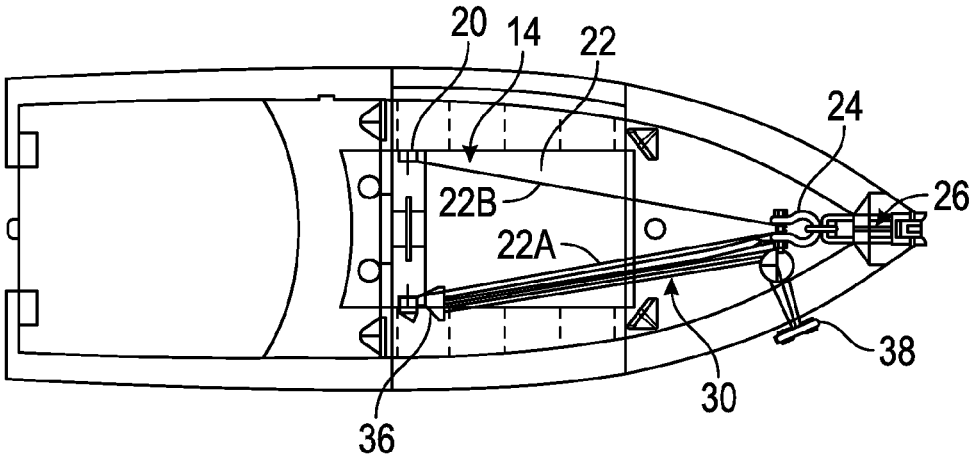
FIG. 3 is a schematic top view of the deployed vessel in FIG. 2.
Figure 4:
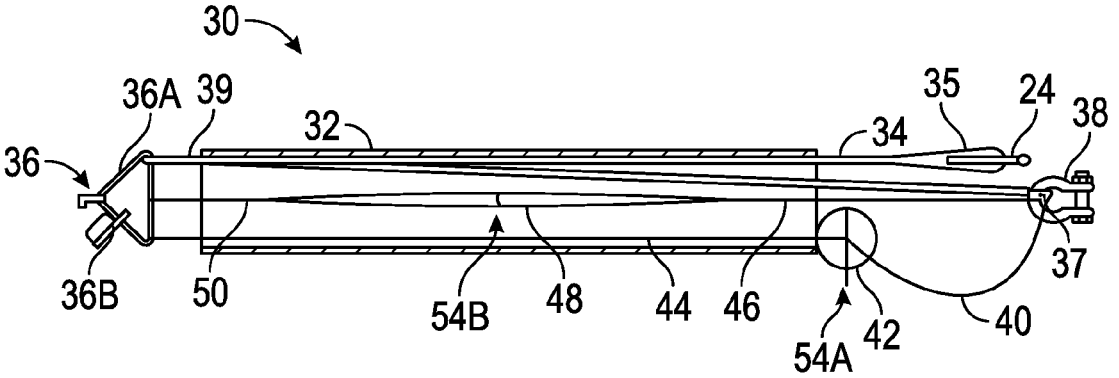
FIG. 4 is a schematic detailed view of a portion of the recovery assembly shown in FIGS. 2 and 3.

FIG. 2 is a schematic elevational view of a deployed vessel in water with an exemplary lift support and recovery assembly. FIG. 3 is a schematic top view of the deployed vessel in FIG. 2. FIG. 4 is a schematic detailed view of a portion of the recovery assembly shown in FIGS. 2 and 3. The figures will be described in conjunction with each other. The deployed vessel is presumed to be already deployed in the water and floating at the water surface 18. In general, the recovery system can be advantageous when an operator has little or no control of the deployed vessel and normal retrieval operations are not available. In such instances, the recovery system described herein can advantageously assist in recovering the deployed vessel.

In general, the recovery system includes a lift support 14 coupled to the surface of the vessel 12 and a recovery assembly 30 coupled to the lift support 14. The lift support 14 can be rotated into a stored position generally laterally on the surface of the deployed vessel 12. The lift support 14 can be coupled to a link 24 that in turn can be coupled to a bow catch system 26. The bow catch system 26 can be coupled to the bow of the vessel 12 in the stored position. The recovery assembly 30 includes various components described below that function as an intermediate assembly between the lift support 14 and ultimately the crane described above that can be used to recover the deployed vessel.

In more detail, the lift support 14 includes a lift support frame 20 coupled to the deployed vessel 12. The lift support frame 20 can be coupled to a portion of the vessel 12 that is aligned with a center of gravity axis through the vessel (shown as axis 70 in FIG. 11). The phrase "aligned with the center gravity" is used to mean that the vessel 12 while being lifted will generally be positioned in an orientation that it would occupy in the water, although it may tilt some amount one way or another.

One or more lift strops 22A, 22B (generally, "strops 22") are coupled to the lift frame 20. The lift strops 22 are broadly defined to include strops, slings, cables, linkages, or frames. The strops 22 can generally rotate through an arc from the lift frame 20 between a lateral position in storage and a more or less vertical position upon lifting the vessel 12 with the crane 6 described herein. In the embodiment shown, a plurality of strops are joined together distally from the lift frame 20 at a link 24. The link 24 in turn can be coupled to the recovery assembly 30.

The recovery assembly 30 can include an enclosure 32 that can be used to store at least a portion of the recovery assembly therein, which can assist in a smooth deployment from the deployed vessel 12. A recovery cable 34 can be coupled to the link 24. The recovery cable 34 can include wire, rope, chain, and other flexible members. The recovery cable 34 can be floating or non-floating. A first portion 35, such as one end, of the recovery cable can be coupled to the link 24, and a second portion 37, such as another end, of the recovery cable 34 can be coupled to a deployment weight 38. The deployment weight 38 can be used to pull the recovery cable 34 into the water upon release of the cable, as described herein. For example, the deployment weight can be positioned so that it hangs vertically from the deck or other portion of the vessel, so that when the recovery cable is released, the deployment weight automatically pulls the recovery cable into the water. Other embodiments can be used, such as projecting the deployment weight with the recovery cable into the water after release. The deployment weight 38 can be a connector, such as a shackle or other component, used to couple other cables and ropes together. An intermediate portion 39 of the recovery cable between the first portion 35 and the second portion 37 can be coupled to a release unit 36 distally from the link 24 and the deployment weight 38. The release unit 36 can be coupled to the lift support frame 20 in at least one embodiment. The release unit 36 can include a release holder 36A and a release actuator 36B. The release holder 36A can hold the intermediate portion 39 before deployment of the recovery cable 34 with the recovery assembly 30. The release actuator 36B is a device that will cause the release holder 36A to release one or more of the cables and lines coupled to the release unit 36B. The release actuator 36B can be remotely actuated, such as through wireless transmission, timed devices, or other actuation methods known to those with ordinary skill in the art. As merely nonlimiting examples, the release actuator 36B can include an explosive charge, solenoid, servo motor, spring loaded release, thermal links, or other devices for releasing, moving, or dislodging components to open the release holder 36A.

The deployment weight 38 can also be coupled to a line 40 that in turn is coupled to a drag device 54A, such as a buoy 42. The term "drag device" is used broadly to include any component that can cause resistance in the water to create drag on the recovery cable 34 after deployment into the water. The term "buoy" is used broadly to include a component that can cause some floatation to the recovery cable 34 after deployment into the water and optionally indicate the location of the recovery cable 34 after deployment into the water. Optionally, the buoy 42 can be also coupled to the release unit 36 with a storage line 44 during storage of the recovery assembly 30 before deployment.

The deployment weight 38 can also be coupled to a line 46 which in turn is coupled to another drag device 54B, such as a drift anchor 48. The term "drift anchor" is broadly used for a component deployed in the water that causes resistance to the deployed vessel's movement, so that a line or lines stretched between the vessel 12 and the drift anchor 48 can become relatively taut as the vessel drifts with the current or wind. The drift anchor 48 can also be coupled to the release unit 36 with a storage line 50 during storage of the recovery assembly 30 before deployment.

Thus, in the exemplary embodiment, the release actuator 36B could be actuated remotely and cause the release holder 36A to release the recovery cable 34, storage line 44 with the buoy 42, and storage line 50 with the drift anchor 48 for deployment of the recovery assembly 30 into the water. The deployment of the recovery assembly 30 can be enhanced by allowing the deployment weight 38 to hang from the recovery vessel 12, so that the deployment weight 38 assists in deploying the recovery assembly from the vessel upon actuation of the release actuator 36B.

The drag device, generally referenced as 54, can thus include the buoy 42, the drift anchor 48, or a combination thereof, in one or more elements. The deployment weight 38 assists in initially deploying by gravity the recovery cable 34 upon release of the recovery cable from the release unit 36. After the drag device 54 is deployed into the water, the drag device can assist in further deployment of the recovery cable 34 from the deployed vessel 12.

In some embodiments, the drag device 54, including a buoy 42, can operate with sufficient drag on the recovery cable, so that the drift anchor 48 is not used. In other embodiments, the drag device 54, including a drift anchor 48, can operate without the buoy 42. A floating recovery cable 34 may assist in using the drift anchor 48 without the buoy 42. In still other embodiments, multiple drag devices, such as both a buoy 42 and a drift anchor 48, can be used, as has been illustrated in the figures as an exemplary embodiment, with the understanding that one or the other of the drag devices could be removed from the figures for other exemplary embodiments.

Figure 5:
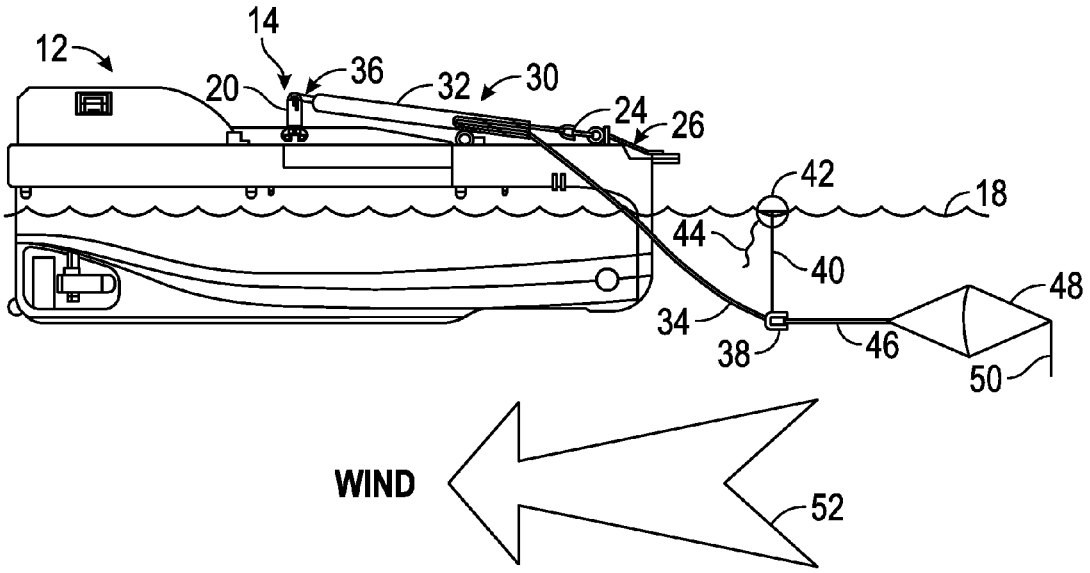
FIG. 5 is a schematic elevational view of the exemplary recovery assembly when partially deployed.
Figure 6:
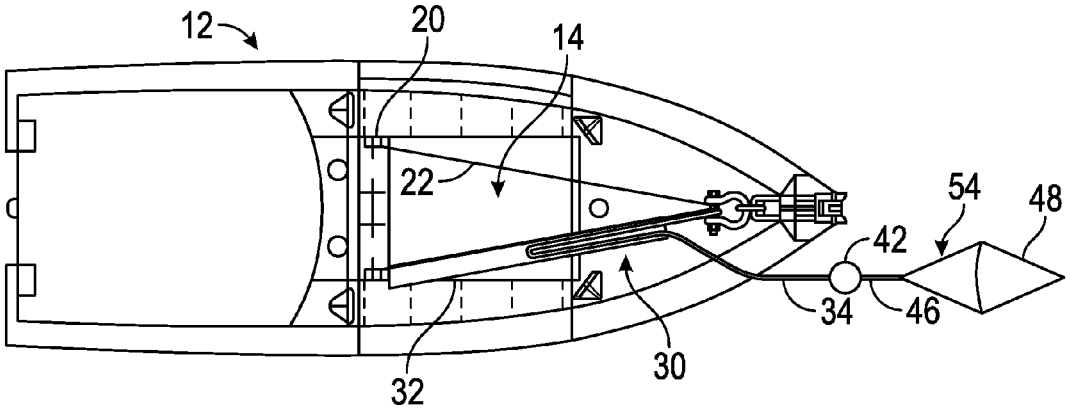
FIG. 6 is a schematic top view of the partially deployed recovery assembly.

FIG. 5 is a schematic elevational view of the exemplary recovery assembly when partially deployed. FIG. 6 is a schematic top view of the partially deployed recovery assembly. The figures will be described in conjunction with each other. When the release unit 36 is activated and releases the recovery assembly 30, the deployment weight 38 with the line 40 and buoy 42, line 46 and drift anchor 48, and recovery cable 24 begin deployment from the vessel 12 assisted by the deployment weight 38. In the water, the drag device 54 (such as a buoy 42 and/or drift anchor 48) can provide resistance to movement of the vessel 12, so that the recovery cable 34 continues to be deployed to a full deployment. Further, a buoy 42 (if used and which can be coupled to the deployment weight 38 through the line 40) can assist in suspending the assembly in the water. In general, the vessel 12 will drift with the wind and/or current in the direction 52. With the drift anchor 48 resisting the movement, the recovery cable 34 will extend in line with the vessel movement. As the recovery assembly 30 is deployed, the lift support 14 can remain in the lowered stored position, so that lift strops 22 remain in the lowered stowed position.

Figure 7:
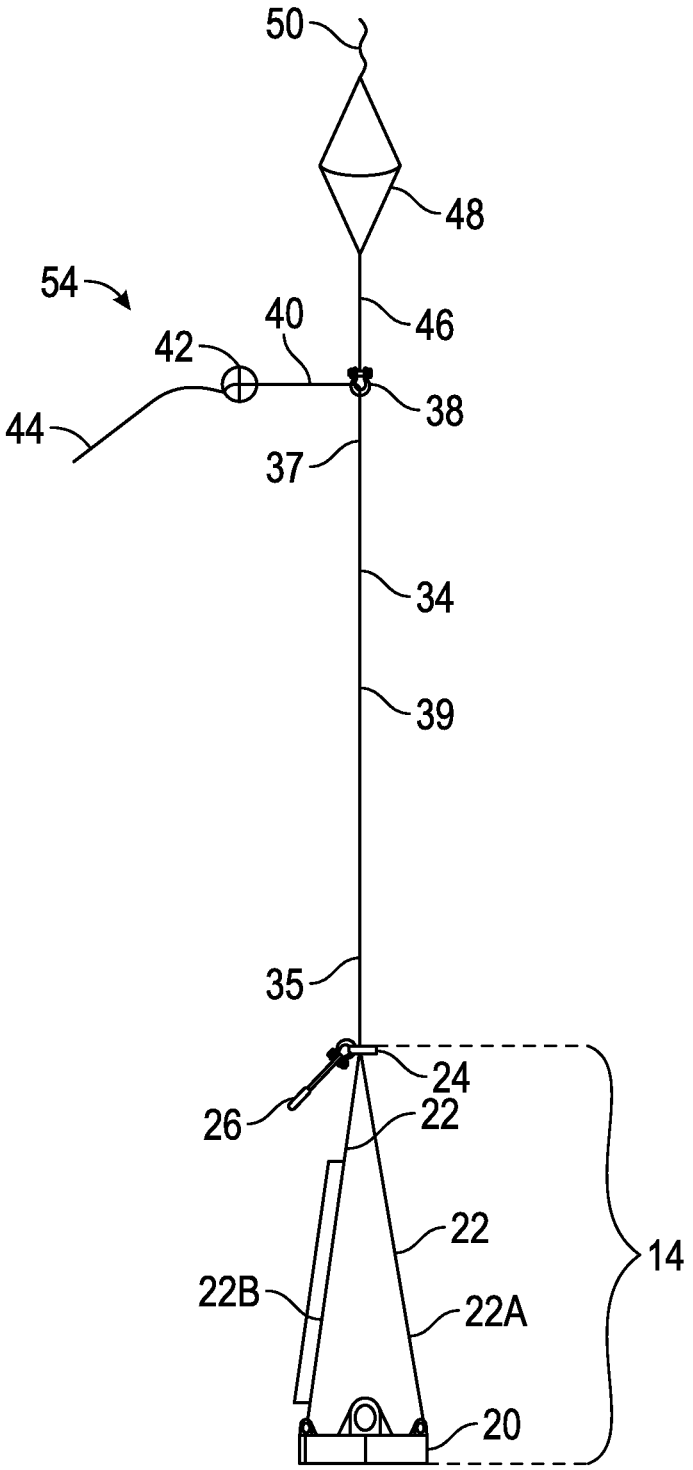
FIG. 7 is a schematic view of the exemplary deployed recovery assembly.

FIG. 7 is a schematic view of the exemplary deployed recovery assembly. When the recovery assembly 36 is deployed from the vessel 12, the lineup of the exemplary embodiment of the lift support 14 and the recovery assembly 30 will generally appear as shown in FIG. 7. Starting with the top of the figure, the remains of the storage line 50 may dangle from the end of the drift anchor 48. The drift anchor 48 can be coupled to the deployment weight 38 through the line 46. Further. the buoy 42 can be coupled to the deployment weight 38 through the line 40. The remains of the storage line 44 may dangle from the buoy 42. The second portion 37 of the recovery cable 34 can be connected to the deployment weight 38. The intermediate portion 39 of the recovery cable that was coupled with the release holder 36A has been fully deployed. The first portion 35 of the recovery cable 34 is coupled to the link 24. The link 24 can be coupled to a plurality of strops 22A, 22B on one end of the strops. Further, a bow catch system 26 can also be coupled to the master link 24, so that the strops 22 can remain in a stowed position until deployment. The other end of the strops 22 can be coupled to the lift support frame 20. The lift support frame 20 can be coupled to the vessel 12, as described above. In general, the lift support frame 20, strops 22, and master link 24 form the lift support 14.

Figure 8:
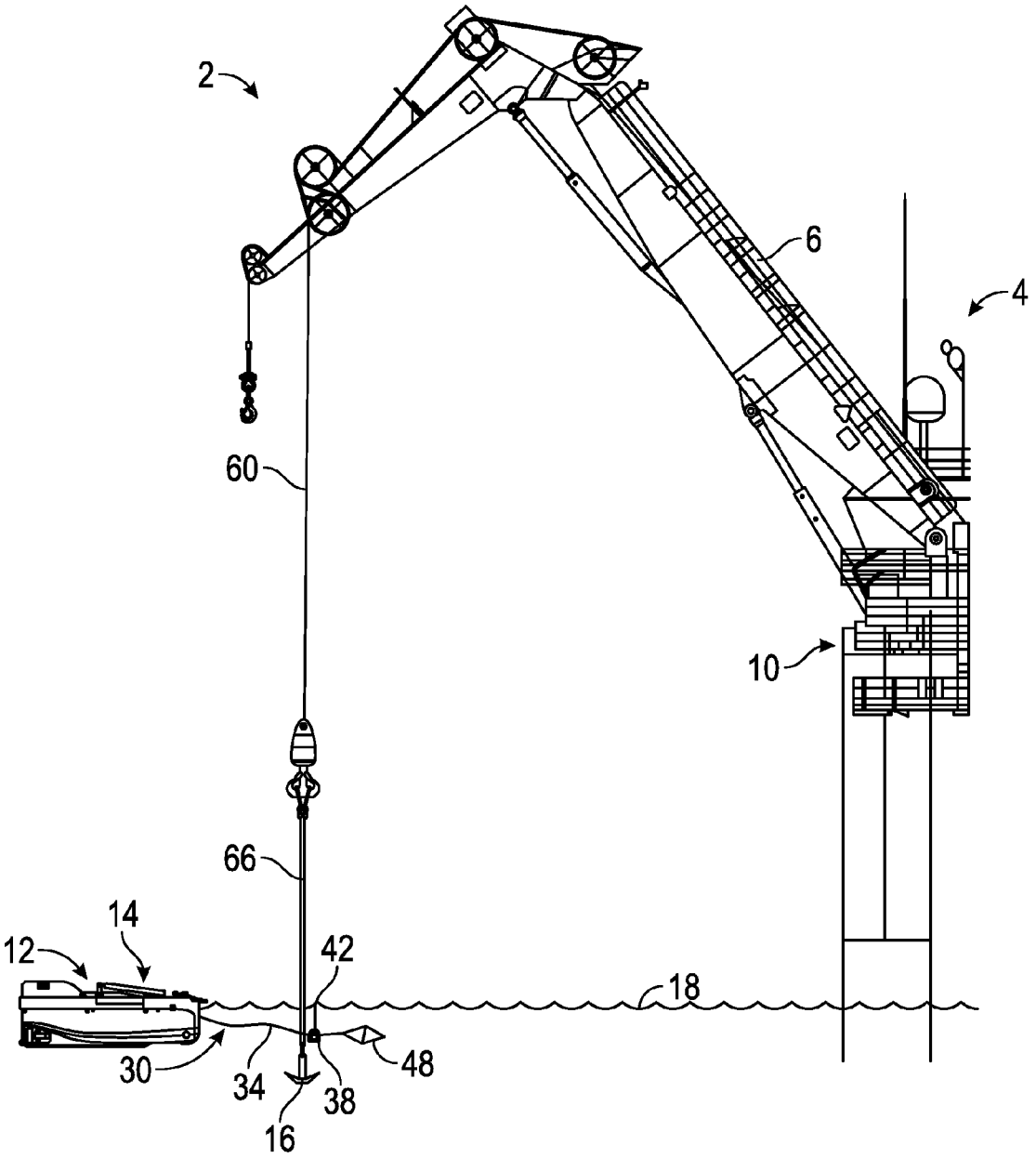
FIG. 8 is a schematic elevational view of the exemplary recovery system showing a recovery vessel, crane, and the deployed vessel with the deployed recovery assembly in the water.
Figure 9:
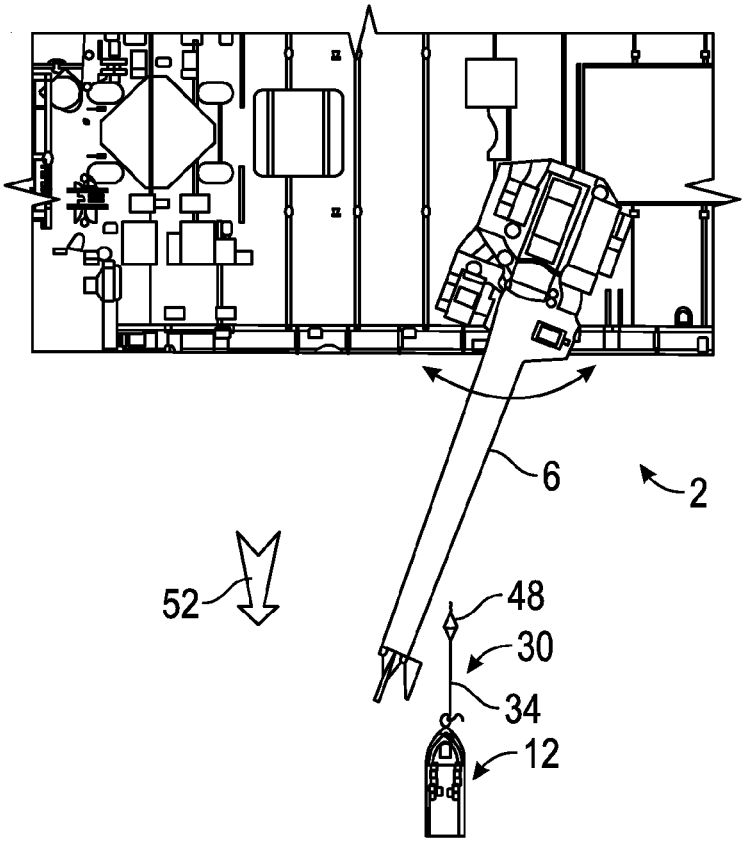
FIG. 9 is a schematic top view of the recovery system in FIG. 8.
Figure 10:
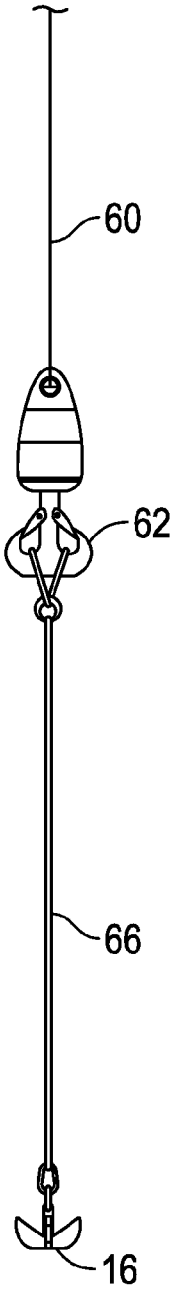
FIG. 10 is a schematic detailed view of the crane cable, engagement cable, and crane coupler that are coupled to the crane shown in FIGS. 8 and 9.

FIG. 8 is a schematic elevational view of the exemplary recovery system showing a recovery vessel, crane, and the deployed vessel with the deployed recovery assembly in the water. FIG. 9 is a schematic top view of the recovery system in FIG. 8. FIG. 10 is a schematic detailed view of the crane cable, engagement cable, and crane coupler that are coupled to the crane shown in FIGS. 8 and 9. The figures will be described in conjunction with each other. After deployment, a recovery vessel 4 can be positioned so that the crane 6 can articulate out from the recovery vessel into position to snag the recovery assembly 30 that has been deployed into the water. Generally, the drag device 54 will cause the recovery assembly 30 to be deployed in line with an orienting direction caused by wind or water current on the vessel 12. The crane 6 can lower a crane cable 60 which generally will include a crane coupler 62. The crane coupler 62 can be coupled to an engagement cable 66 which in turn can be coupled with the recovery coupler 16. The recovery coupler 16 can include a grappler hook or other device used to engage the recovery cable 34 of the recovery system 30.

In a typical embodiment, the crane 6 can rotate using its rotation system to sweep the recovery coupler 16 at an angle across the recovery cable 34. By watching movement of the drag device 54, such as a buoy 42, an operator can determine when the sweeping action has caused the recovery coupler 16 to engage the recovery cable 34. Thus, the recovery system 2 generally includes the recovery assembly 30 in conjunction with the crane 6 and the recovery vessel 4.

Figure 11:
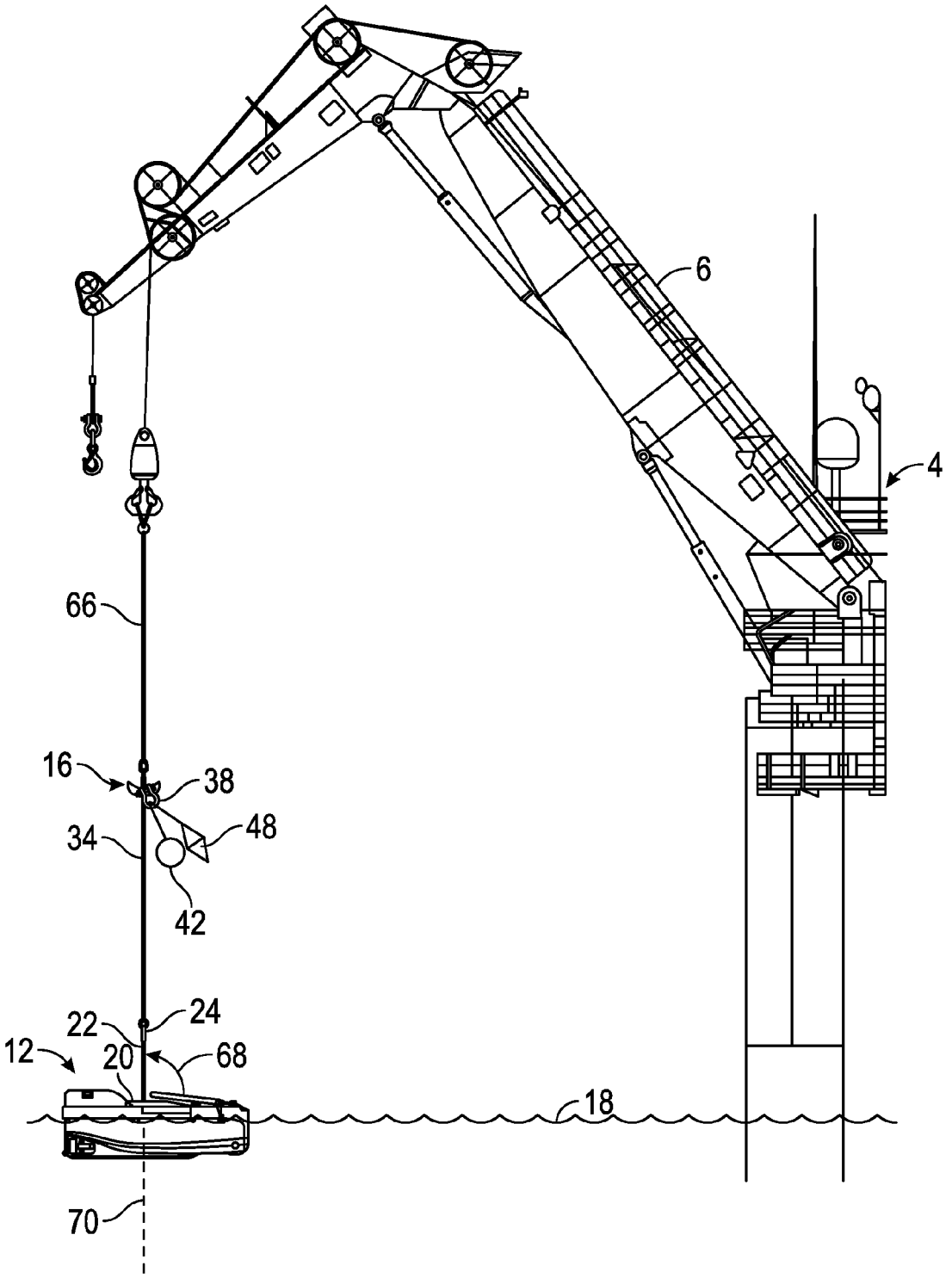
FIG. 11 is a schematic elevational view of the crane lifting the recovery cable and the lift strops to a vertical position with the deployed vessel in the water.

FIG. 11 is a schematic elevational view of the crane lifting the recovery cable and the lift strops to a vertical position with the deployed vessel in the water. Once the recovery coupler 16 has engaged the recovery cable 34, the crane 6 can articulate upward and/or retrieve the crane cable 60. As the recovery coupler 16 moves vertically upward, it will slide along the recovery cable 34 until it stops sliding at the deployment weight 38. The crane can continue lifting the recovery coupler 16 with the recovery cable 34 to lift the deployment weight 38 and the components connected thereto in a vertical direction. As further lifting occurs, the strops 22 of the lift support 14 rotate upward, generally in an arc 68 to a vertical position. Because the lift support frame 20 is coupled to the vessel 12 generally in line with an axis 70 of center of gravity of the deployed vessel 12, then the lifting location for the strops 20 (in this embodiment at master link 24) will also be aligned with the axis 70 as the vessel is lifted. It is understood that additional strops can be used and the additional strops might form a triangular lifting arrangement or other lifting arrangement due to the multiple strops. In general, it is advantageous to position the junction of the strops, so that the vessel can remain in the general orientation during lifting that it had when floating in the water.

Figure 12:
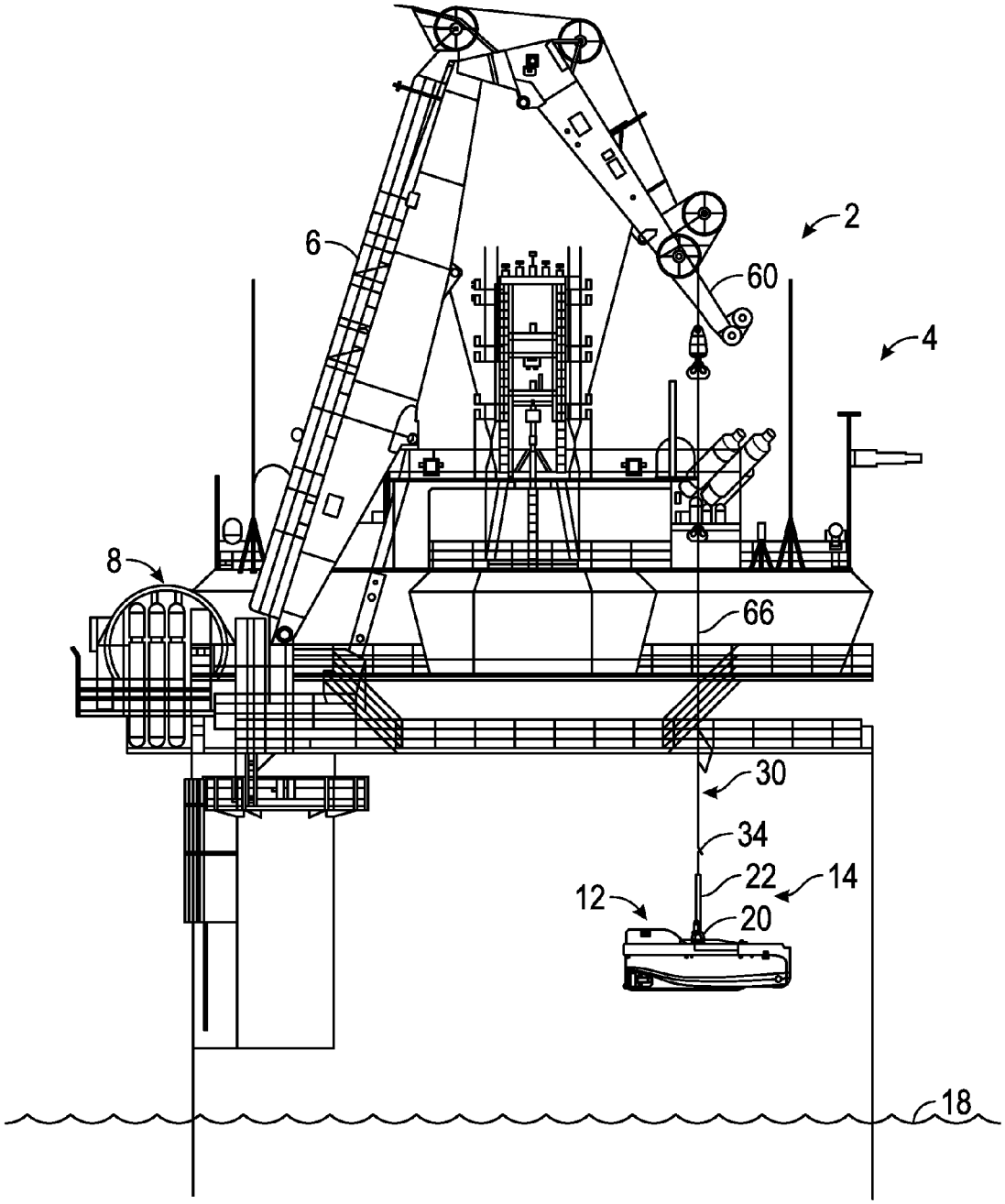
FIG. 12 is a schematic elevational view of the crane lifting the deployed vessel with the lift strops vertically from the water with the lift strops.

FIG. 12 is a schematic elevational view of the crane lifting the deployed vessel vertically from the water with the lift strops. The recovery system 2 with the recovery vessel 4 and the crane 6 continues lifting the crane cable 60 with the engagement cable 66 coupled to the recovery cable 34 of the recovery assembly 30. The recovery assembly is coupled to the strops 22 of the lift support 14, which in turn is coupled to the vessel 12 through the support frame 20. Advantageously, the vessel remains relatively horizontal as it was when floating in the water by lifting in alignment with the axis 70 of the center of gravity.

Other and further embodiments utilizing one or more aspects of the invention described above can be devised without departing from the spirit of Applicant's invention. For example, it is possible to have different locations for the lift support that may not be in line with the axis of center of gravity, different arrangements of the recovery cable and components, optional coupling of the buoy and/or drift anchor with the release unit, variations on the type of weights and connectors for the lines, the number of components and their shape and size, variations in the type of crane or other lifting device, various types of other drag devices, buoys, and drift anchors other than as shown that are encompassed within the definitions herein, and other variations in keeping with the scope of using a recovery system to recover a deployed vessel.

Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A system for recovery of a deployed vessel in water, comprising:

a lift support coupled to a surface of the deployed vessel in line with a center of gravity of the deployed vessel, the lift support comprising:

a lift support frame coupled to the surface of the deployed vessel;

a lift strop coupled to the lift support frame, the lift strop being rotatable from a first position when stored to a vertical position when used to lift the deployed vessel; and a recovery assembly coupled to the lift support, comprising:

a recovery cable having a first portion and a second portion, the first portion coupled to the lift strop, the recovery cable being configured to couple to a recovery vessel to lift the deployed vessel from the water;

a deployment weight coupled to the recovery cable;

a drag device coupled to the second portion of the recovery cable; and a release unit comprising a release holder and a release actuator, the recovery cable being releasably coupled to the release unit.

2. The system of claim 1, wherein the drag device is releasably coupled to the release unit.

3. The system of claim 1, wherein the drag device comprises a drift anchor, a buoy, or a combination thereof.

4. The system of claim 1, wherein the lift strop in a stored condition is coupled to a bow of the deployed vessel.

5. The system of claim 1, further comprising at least two drag devices, a first drag device comprising a buoy, and a second drag device comprising a drift anchor, wherein the buoy is coupled with a line to the second portion of the recovery cable and the drift anchor is coupled with a line to the second portion of the recovery cable and wherein in deployment of the recovery cable, the buoy is positioned between the recovery vessel and the drift anchor.

6. The system of claim 1, further comprising a storage enclosure in which at least a portion of the recovery cable is stored before deployment of the recovery assembly.

7. The system of claim 1, a crane coupled to a recovery vessel having a crane coupler to releasably couple with the recovery cable and lift the deployed vessel vertically from the water.

8. The system of claim 1, wherein the release actuator is configured to be remotely actuated.

9. The system of claim 1, wherein the drag device comprises a buoy and the recovery cable comprises a floating cable or a non-floating cable.

10. The system of claim 1, wherein the drag device comprises a drift anchor and the recovery cable comprises a floating cable or a non-floating cable.

11. A method of recovering a deployed vessel in water with a lift support and a recovery system coupled to the lift support, the lift support having a lift support frame coupled to a surface of the deployed vessel and a lift strop coupled to the lift support frame, and the recovery assembly having a recovery cable with a first portion and a second portion, the first portion coupled to the lift strop, a deployment weight coupled to the recovery cable, a drag device coupled to the second portion of the recovery cable, and a release unit having a release holder and a release actuator, the recovery cable being releasably coupled to the release unit, the method comprising:

actuating the release actuator of the release unit;

releasing the recovery cable with the drag device from the release unit;

allowing the recovery cable to be pulled from the deployed vessel by the deployment weight into the water;

dragging the recovery cable in the water with the drag device;

orienting a recovery vessel with a crane to position a crane coupler in the water at an angle to the recovery cable;

coupling the crane coupler with the recovery cable;

lifting the crane coupler coupled to the recovery cable with the crane;

rotating the lift strop from a first position to a vertical position in line with a center of gravity of the deployed vessel; and lifting the deployed vessel from the water with the lift strop.

12. The method of claim 11, further comprising allowing the drag device to orient the deployed vessel head-to-sea after the drag device is deployed.

13. The method of claim 11, further comprising rotating the crane with the crane coupler about a vertical axis to engage the crane coupler with the recovery cable.

14. The method of claim 11, further comprising:

releasably coupling the drag device to the release unit; and releasing the drag device when the recovery cable is released.

15. The method of claim 11, wherein actuating the release actuator of the release unit occurs remotely.

* * * * *